US010485323B2

(12) United States Patent
Soga

(10) Patent No.: US 10,485,323 B2
(45) Date of Patent: Nov. 26, 2019

(54) APPLYING CONTAINER AND METHOD FOR MANUFACTURING THE SAME

(71) Applicant: TOKIWA CORPORATION, Gifu (JP)

(72) Inventor: Kenichi Soga, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 171 days.

(21) Appl. No.: 15/633,909

(22) Filed: Jun. 27, 2017

(65) Prior Publication Data

US 2018/0020809 A1 Jan. 25, 2018

(30) Foreign Application Priority Data

Jul. 21, 2016 (JP) ..... 2016-143378

(51) Int. Cl.
*A45D 40/06* (2006.01)
*A45D 40/20* (2006.01)

(52) U.S. Cl.
CPC ..... *A45D 40/06* (2013.01); *A45D 40/205* (2013.01); *A45D 2040/208* (2013.01)

(58) Field of Classification Search
CPC .... A45D 40/06; A45D 40/065; A45D 40/205; A45D 40/208
USPC ..... 401/756, 75
See application file for complete search history.

(56) References Cited

U.S. PATENT DOCUMENTS 6,273,626 B1 * 8/2001 Yazawa ..... B43K 23/008 401/6
2012/0211019 A1 8/2012 Wolfsgruber
2012/0288321 A1 11/2012 Ishida
2013/0322949 A1 * 12/2013 Braeuer ..... A45D 40/04 401/68

FOREIGN PATENT DOCUMENTS

| | | |
|---|---|---|
| CN | 102641037 | 8/2012 |
| CN | 102771988 | 11/2012 |
| JP | 4697932 | 3/2011 |
| KR | 10-2009-0065402 | 6/2009 |
| KR | 2010-0060894 | 6/2010 |
| WO | 2009/078528 | 6/2009 |

OTHER PUBLICATIONS

Office Action issued in Republic of Korea Counterpart Patent Appl. No. 10-2017-0081264, dated May 18, 2018.
Office Action issued in Taiwan Counterpart Patent Appl. No. 106122172, dated Nov. 17, 2017.

* cited by examiner

*Primary Examiner* — Huyen D Le
(74) *Attorney, Agent, or Firm* — Greenblum & Bernstein, P.L.C.

(57) ABSTRACT

A leading tube of an applying container includes a plurality of projections rearward with respect to a top end surface and an outer surface side part where the plurality of projections project. The plurality of projections and the outer surface side part are made of a soft material. The leading tube further includes a tube hole formation part inside the outer surface side part and an interposing part. The interposing part interposes the tube hole formation part and the outer surface side part from a front and a rear in an axial direction. The tube hole formation part and the interposing part are made of a hard material.

9 Claims, 12 Drawing Sheets

APPLYING CONTAINER AND METHOD FOR MANUFACTURING THE SAME

TECHNICAL FIELD

The present disclosure relates to an applying container to apply a content and a method for manufacturing the same.

BACKGROUND ART

There has been conventionally known an eyebrow pencil described in the following Patent Literature 1. This eyebrow pencil described in Patent Literature 1 houses a rod-shaped cosmetic material for eyebrow in a rod-shaped cosmetic material feeding container. A feeding operation feeds the rod-shaped cosmetic material from an opening at a container tip to draw an eyebrow by the fed rod-shaped cosmetic material, so that the cosmetic material is applicable. This rod-shaped cosmetic material feeding container has a bristle at a container tip end. The bristle gradates the eyebrow drawn by the rod-shaped cosmetic material. The container is made of a material such as a plastic, a metal, and a glass. The bristle is implanted into the container, for example, by a configuration of projecting forward from a container top end surface and by a configuration of projecting outward from an outer surface of the container tip end or is mounted to the container by a configuration of surrounding a peripheral area of the container tip end. Thus disposing the bristle at the container tip end allows the gradation with the bristle after the eyebrow is drawn with the rod-shaped cosmetic material, without inverting the container and changing the hold of the container.

CITATION LIST

Patent Literature

Patent Literature 1: Japanese Patent No. 4697932

Technical Problem

However, while appropriate for the gradation of eyebrow, the bristle is unsuitable for other processes such as a comb. Moreover, the bristle requires work to transplant the hair to and be mounted to the container, and this causes a problem such as a laborious production and a cost increase.

Therefore, an object of the present disclosure is to provide an applying container that allows various processes such as a process to comb and gradate an applied portion with not a bristle but a soft material without inverting the container and changing the hold of the container while a content such as a rod-shaped cosmetic material is applicable to the applied portion; and a method for manufacturing the applying container by which this applying container can be easily manufactured.

SUMMARY OF INVENTION

An applying container according to the present disclosure is configured to apply a content housed inside the applying container. The content passes through a tube hole at a leading tube and appears from an opening at a top end surface of the leading tube for the application. The applying container includes the leading tube. The leading tube includes a plurality of projections, an outer surface side part, a tube hole formation part, and an interposing part. The plurality of projections are made of a soft material and projects at an outer surface rearward with respect to the top end surface. The outer surface side part is made of the soft material and the plurality of projections project at the outer surface side part rearward with respect to the top end surface. The tube hole formation part is made of a hard material harder than the soft material. The tube hole formation part is positioned inside the outer surface side part and forms the tube hole. The interposing part is made of the hard material harder than the soft material. The interposing part interposes the tube hole formation part and the outer surface side part from a front and a rear in an axial direction. The leading tube is constituted of the two kinds of materials.

With this applying container, the leading tube includes the plurality of projections rearward with respect to the top end surface and the outer surface side part where the plurality of projections project. The plurality of projections and the outer surface side part are made of the soft material. The leading tube further includes the tube hole formation part inside the outer surface side part and the interposing part made of the hard material. The interposing part interposes the tube hole formation part and the outer surface side part from the front and the rear in the axial direction. While the content appearing from the opening at the top end surface of the leading tube is applicable to the applied portion, various processes such as a comb and a gradation to the applied portion can be performed with the plurality of projections constituted of the soft material without inverting the container and changing the hold of the container.

Further, configuring the outer surface side part to have the tubular shape does not cause a drop of the outer surface side part from the leading tube.

Furthermore, with the rod-shaped cosmetic material for eyebrow as the content, an eyebrow can be drawn with the rod-shaped cosmetic material for eyebrow. Additionally, the processes to comb and gradate the eyebrow can be preferably performed by a direction that a user moves the plurality of projections relative to the eyebrow.

A method for manufacturing an applying container according to the present disclosure is a method for manufacturing an applying container configured to apply a content housed inside the applying container. The content passes through a tube hole at a leading tube and appears from an opening at a top end surface of the leading tube for the application. The method includes molding a plurality of projections and an outer surface side part of the leading tube with a soft material. The plurality of projections project at an outer surface rearward with respect to the top end surface. The plurality of projections project at the outer surface side part rearward with respect to the top end surface. The method further includes molding a tube hole formation part and an interposing part of the leading tube with a hard material harder than the soft material. The tube hole formation part is positioned inside the outer surface side part. The tube hole formation part forms the tube hole. The interposing part interposes the tube hole formation part and the outer surface side part from a front and a rear in an axial direction. The projections and the outer surface side part molded with the soft material and the tube hole formation part and the interposing part molded with the hard material are integrally molded with the two kinds of materials by a two-color molding. This ensures easily manufacturing the leading tube.

Advantageous Effects of Invention

Thus, the present disclosure can provide an applying container that allows various processes to an applied portion over which a content has been applied with a plurality of projections made of a soft material on a tip end outer surface without inverting the container and changing the hold of the container while the content is applicable to the applied portion; and a method for manufacturing the applying container by which this applying container can be easily manufactured.

DESCRIPTION OF EMBODIMENTS

Figure 3:
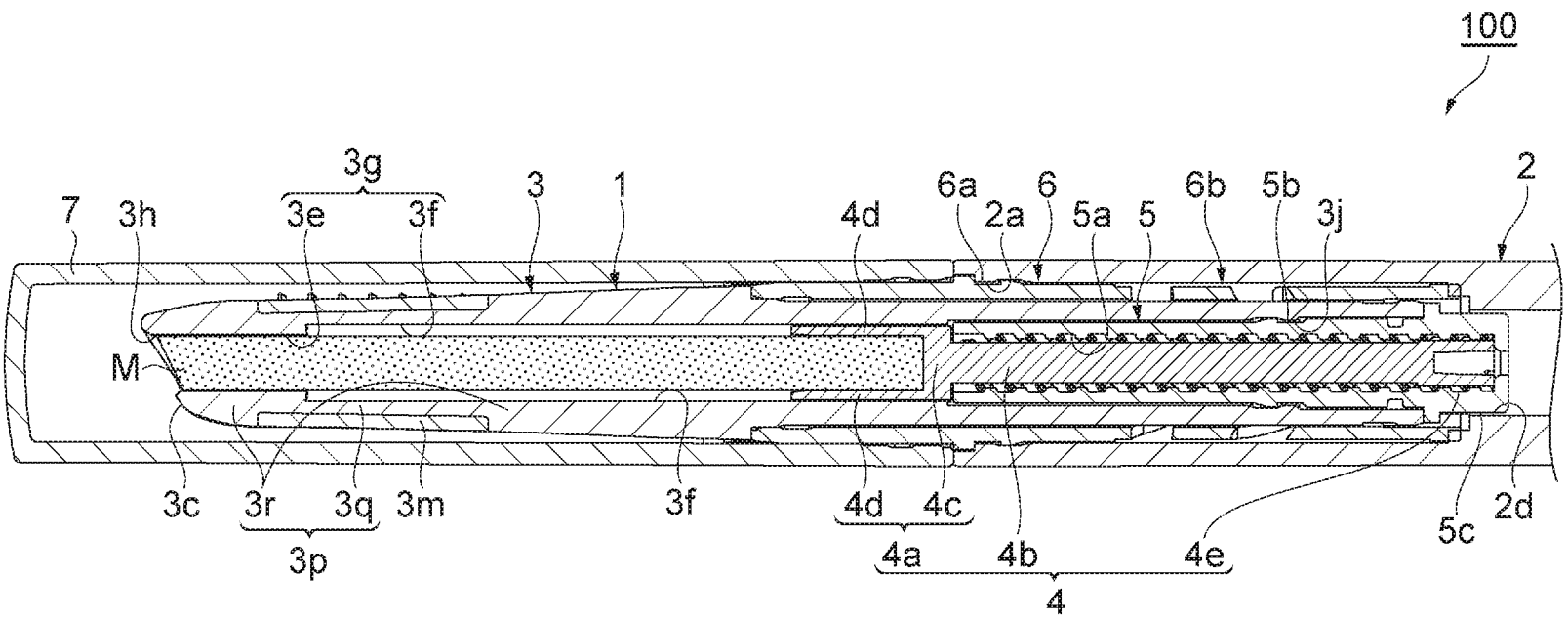
FIG. 3 is a cross-sectional view displacing the cross-sectional position of FIG. 1 to a position including a support piece of a rod-shaped cosmetic material supporting body.
Figure 4:
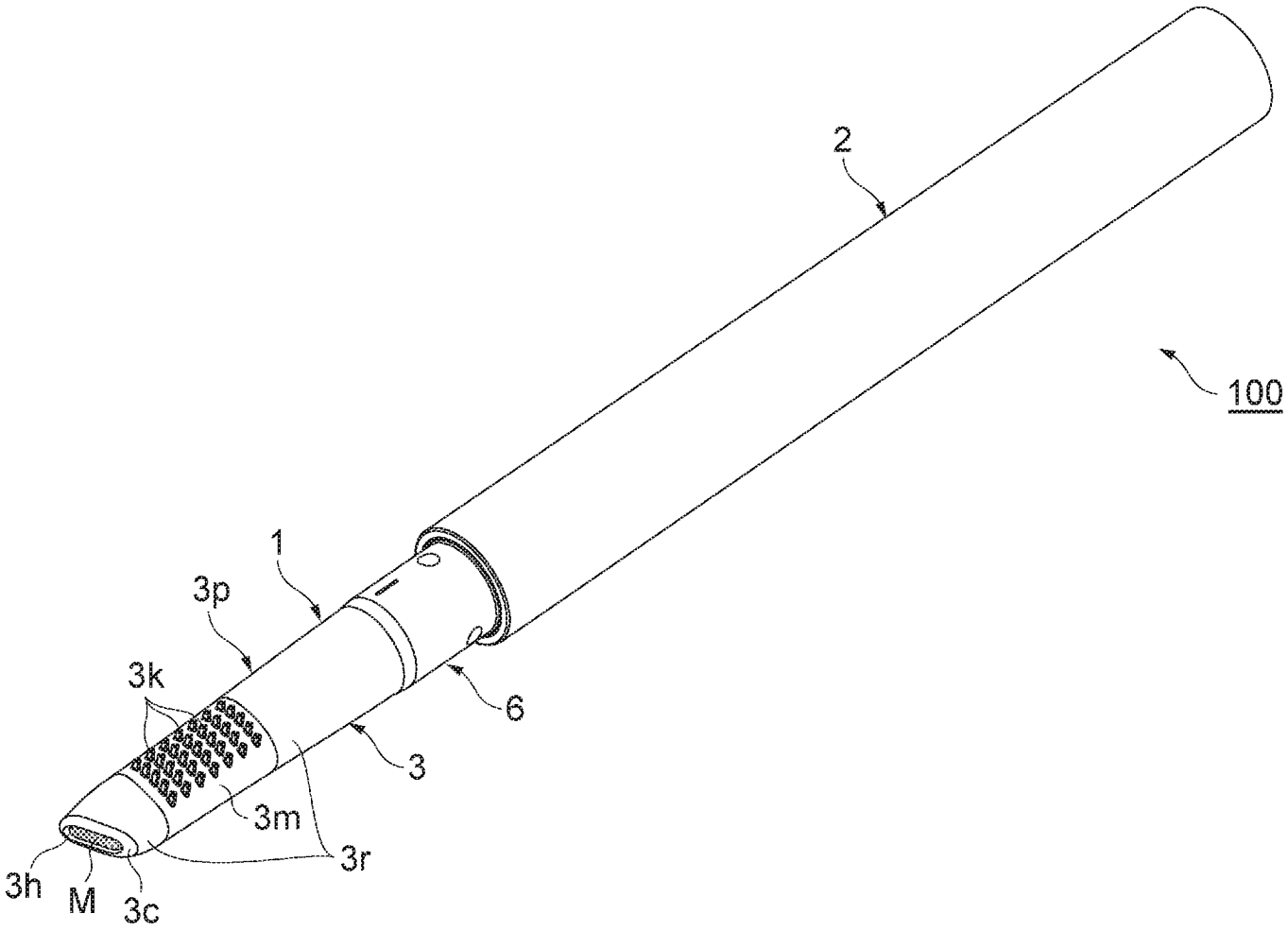
FIG. 4 is a perspective view of the rod-shaped cosmetic material feeding container illustrated in FIG. 1 to FIG. 3 with a cap removed from the rod-shaped cosmetic material feeding container.
Figure 5:
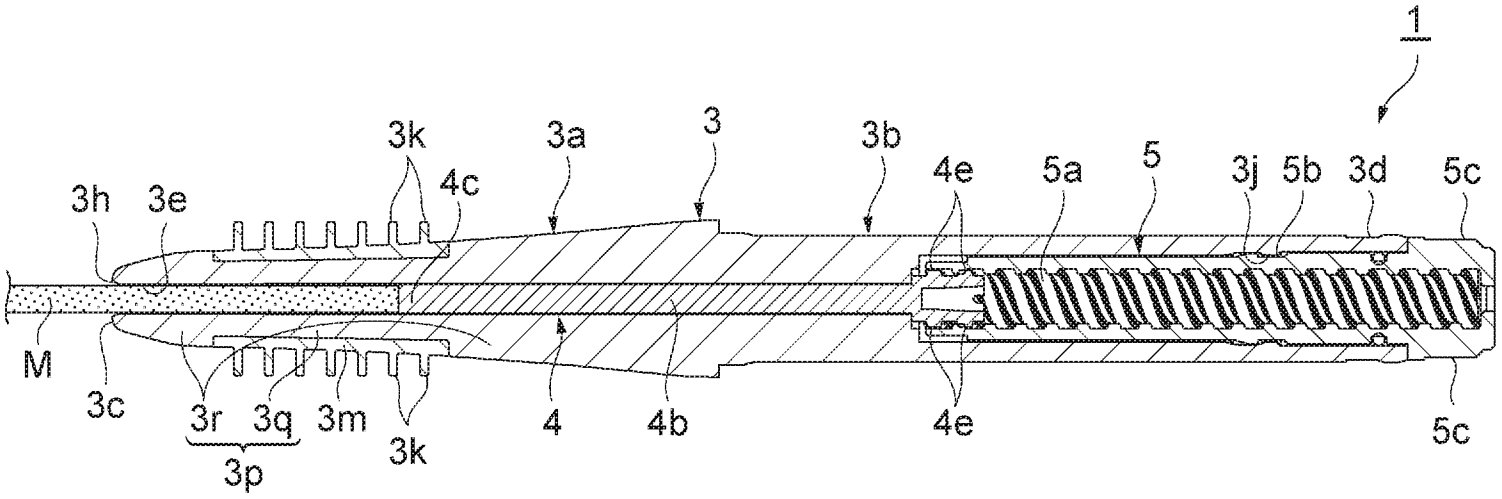
FIG. 5 is a drawing illustrating a rod-shaped cosmetic material cartridge in FIG. 1 to FIG. 4, and is a cross-sectional view corresponding to FIG. 2 where a rod-shaped cosmetic material is fed to an advance limit.
Figure 6:
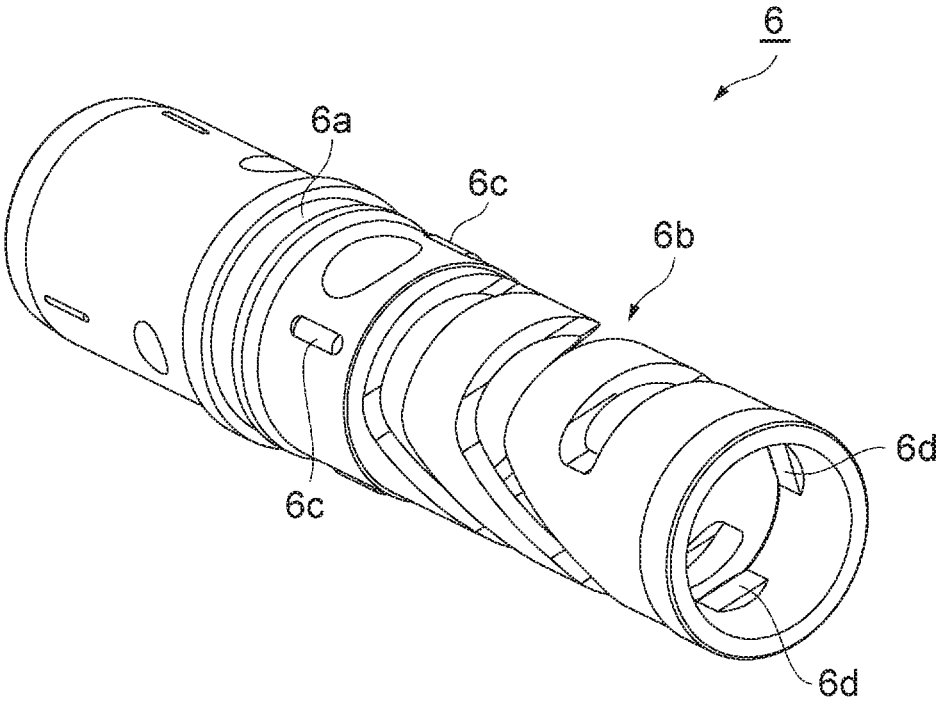
FIG. 6 is a perspective view illustrating a clutch spring member in FIG. 1 to FIG. 3.
Figure 7:
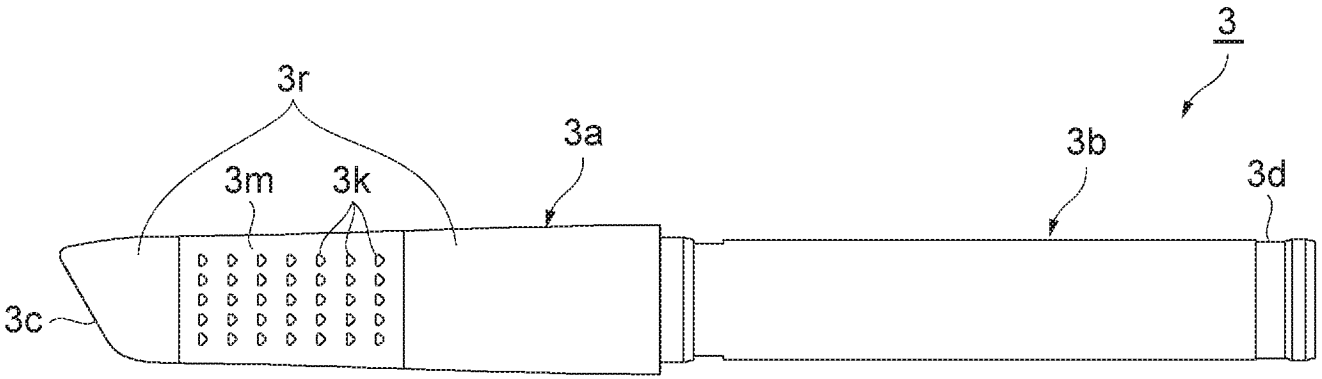
FIG. 7 is a front view illustrating a leading tube in FIG. 1 to FIG. 5.
Figure 8:
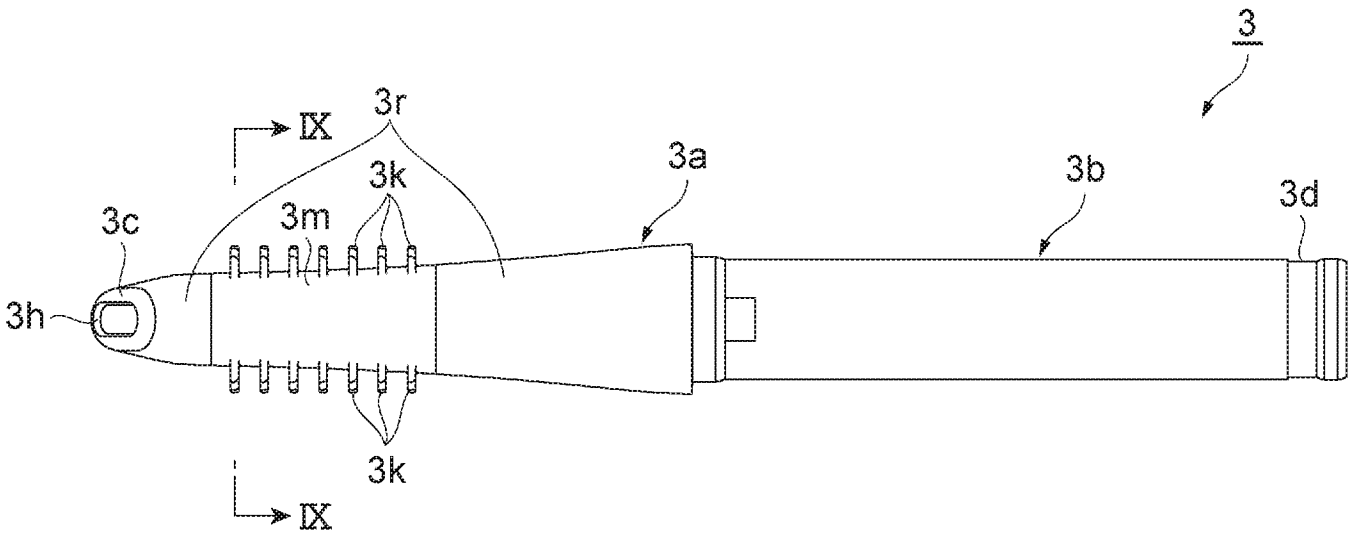
FIG. 8 is a bottom view of FIG. 7.
Figure 9:
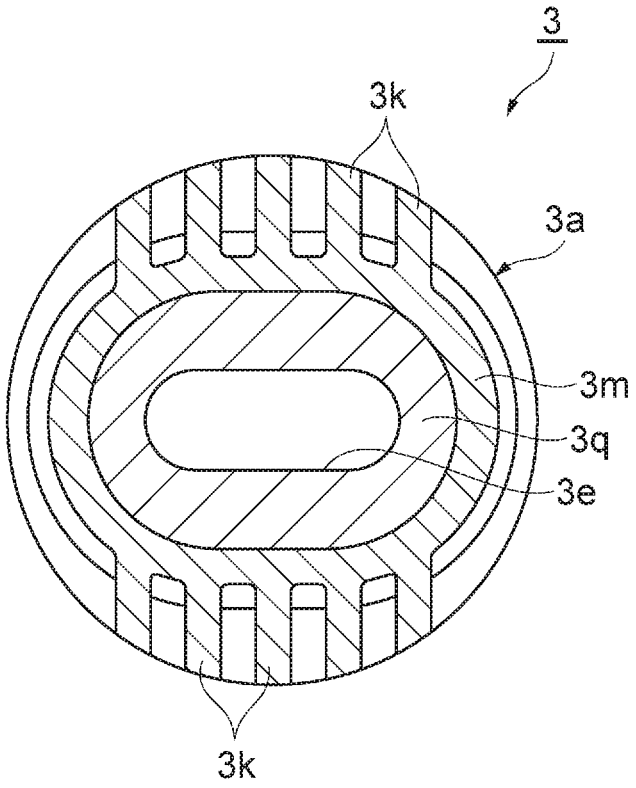
FIG. 9 is an arrow view taken along IX-IX in FIG. 8.
Figure 10:
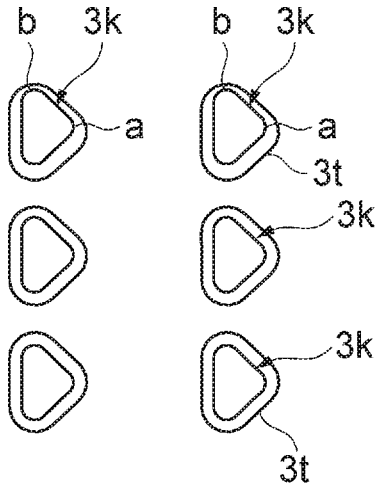
FIG. 10 is an enlarged view illustrating a plurality of projections in FIG. 7.
Figure 11:
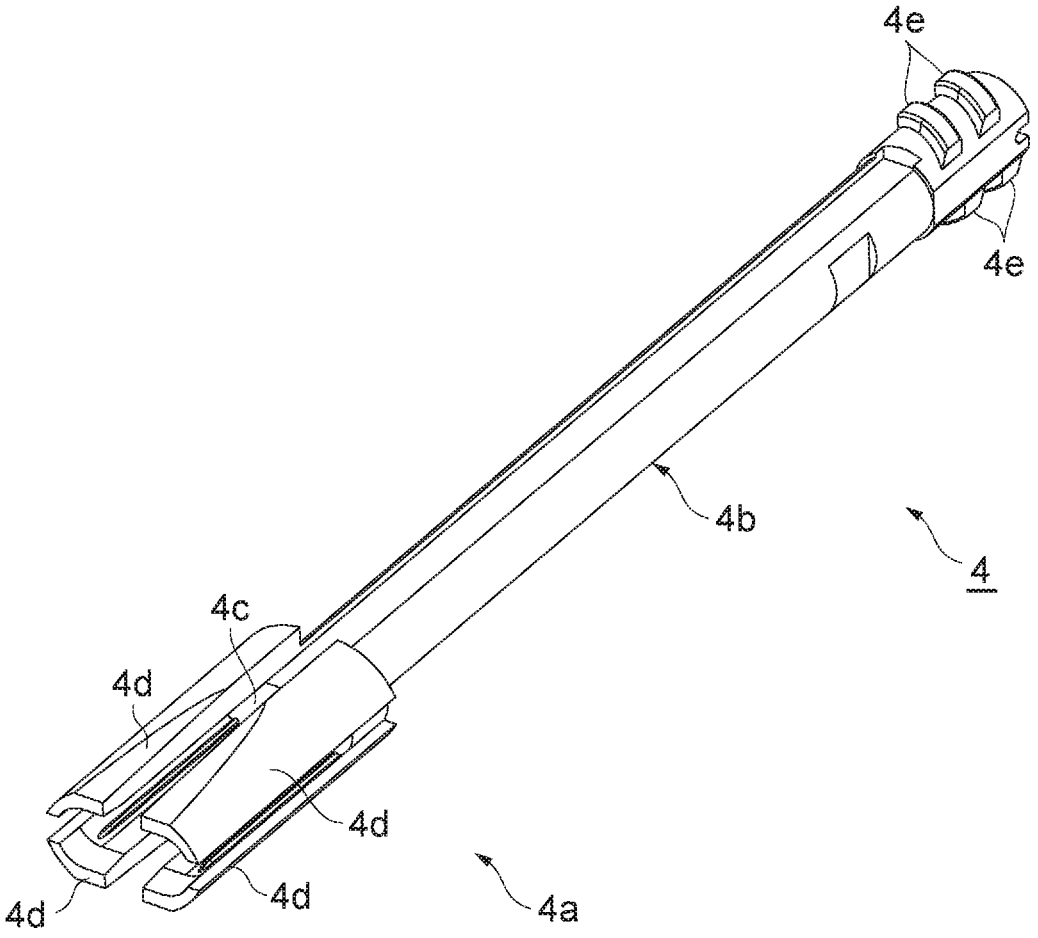
FIG. 11 is a perspective view illustrating the rod-shaped cosmetic material supporting body in FIG. 1 to FIG. 3 and FIG. 5.
Figure 12:
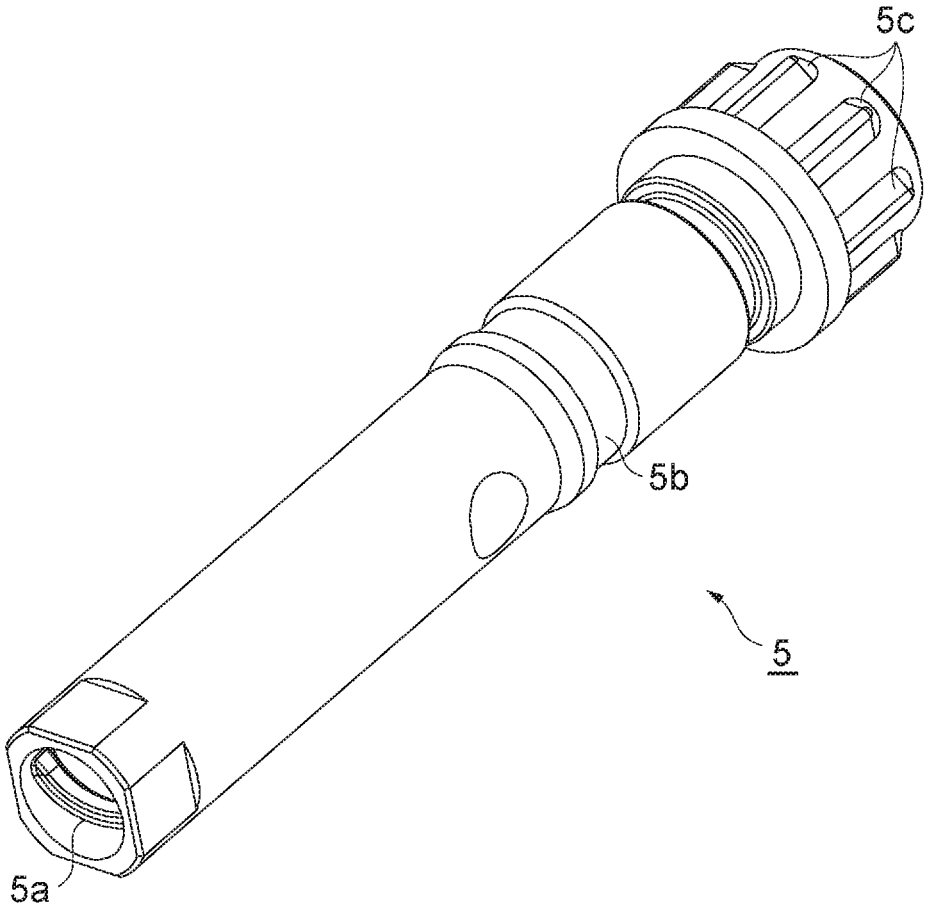
FIG. 12 is a perspective view illustrating a female screw member in FIG. 1 to FIG. 3 and FIG. 5.

The following describes preferable embodiments of a rod-shaped cosmetic material feeding container as an applying container according to the present disclosure and a method for manufacturing the rod-shaped cosmetic material feeding container with reference to FIG. 1 to FIG. 12. FIG. 1 to FIG. 4 are drawings each illustrating the rod-shaped cosmetic material feeding container according to the embodiment of the present disclosure. FIG. 5 is a cross-sectional view illustrating a rod-shaped cosmetic material cartridge. FIG. 6 is a perspective view illustrating a clutch spring member. FIG. 7 to FIG. 9 are drawings each illustrating a leading tube. FIG. 10 is an enlarged view of a plurality of projections. FIG. 11 is a perspective view illustrating a rod-shaped cosmetic material supporting body. FIG. 12 is a perspective view illustrating a female screw member. The rod-shaped cosmetic material feeding container of the embodiment is used by appropriately feeding the rod-shaped cosmetic material housed in the container by a user. The following describes a rod-shaped cosmetic material for eyebrow as the rod-shaped cosmetic material and the rod-shaped cosmetic material feeding container that can feed the rod-shaped cosmetic material for eyebrow as especially preferable.

Figure 1:
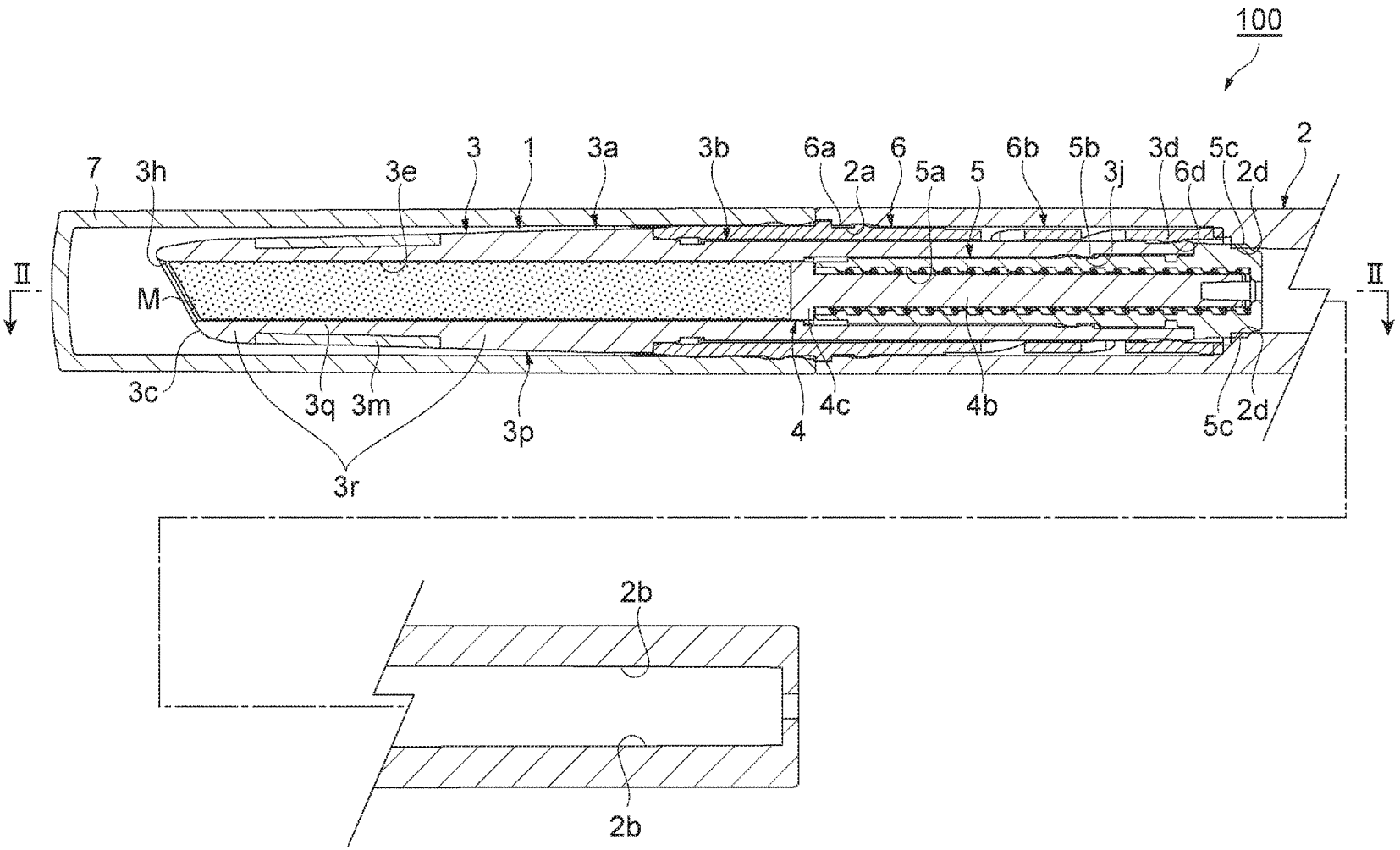
FIG. 1 is a cross-sectional view illustrating a rod-shaped cosmetic material feeding container according to an embodiment of the present disclosure.
Figure 2:
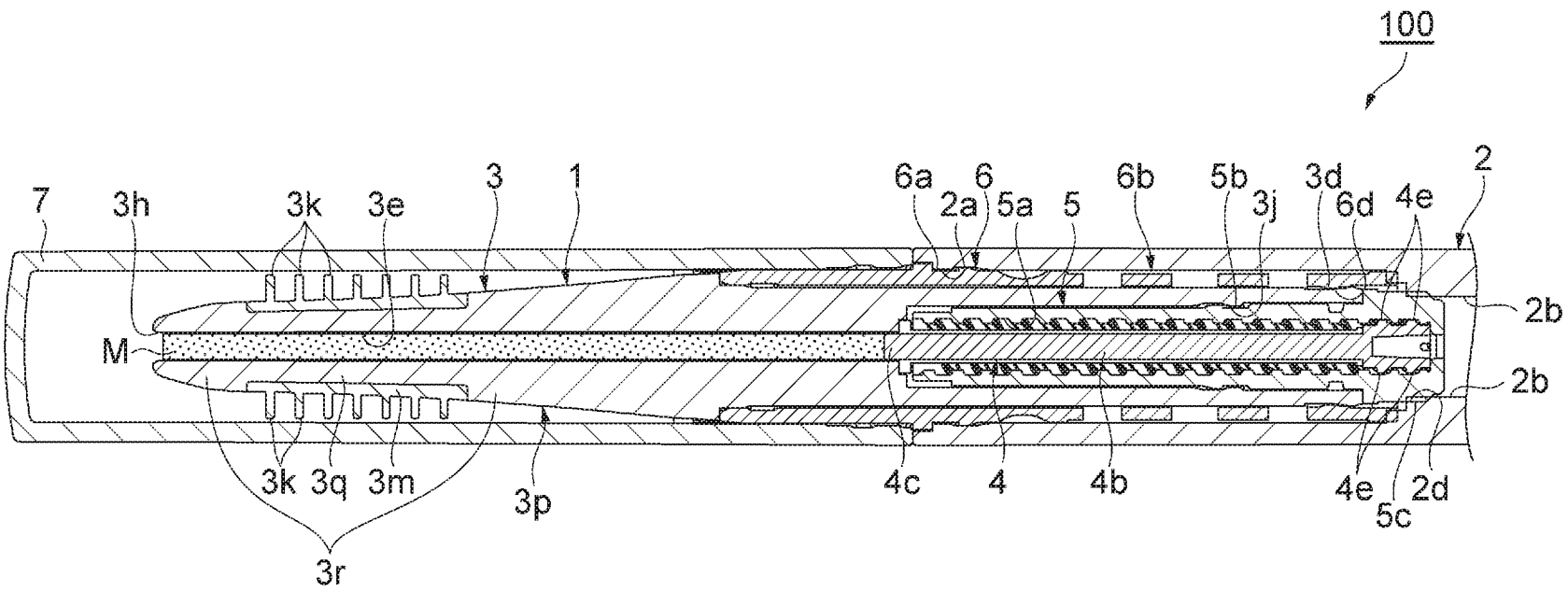
FIG. 2 is an arrow view taken along II-II in FIG. 1.

As illustrated in FIG. 1' to FIG. 4, a rod-shaped cosmetic material feeding container 100 exhibits a satisfactory appearance having an elongate stick shape like a writing material as an entire shape. The rod-shaped cosmetic material feeding container 100 approximately includes a rod-shaped cosmetic material cartridge 1, which constitutes a front portion of the container (see FIG. 5), and a cartridge housing container 2, which constitutes a rear portion of the container, as an external configuration. As illustrated in FIG. 1 to FIG. 3, these rod-shaped cosmetic material cartridge 1 and cartridge housing container 2 internally house a flat rod-shaped cosmetic material for eyebrow (hereinafter simply referred to as a rod-shaped cosmetic material) M, a rod-shaped cosmetic material supporting body 4 (see FIG. 11), which supports the rod-shaped cosmetic material M and includes one of a screw part, a female screw member 5 (see FIG. 12), which includes the other screw part, and a clutch spring member 6 (see FIG. 6), which functions as a so-called clutch by advance and retreat limits of the rod-shaped cosmetic material M.

The cartridge housing container 2 is made of, for example, a polypropylene (PP) and is shaped into a long closed-bottomed cylindrical shape. The cartridge housing container 2 includes a circular convex part 2*a* to axially engage the clutch spring member 6 with the inner peripheral surface on a tip side. A plurality of (four pieces here) concave parts (are not positioned at cross-sectional positions in the drawing and therefore are not illustrated) are circumferentially formed at regular intervals on an inner peripheral surface slightly rearward with respect to the circular convex part 2*a*. The concave parts extend short in the axial direction to engage the clutch spring member 6 in a rotation direction. As illustrated in FIG. 1, a plurality of protrusions 2*b* extending from a bottom portion to around the middle in the axial direction are circumferentially formed at regular intervals on the inner peripheral surface at the rear half portion of the cartridge housing container 2. Inner parts at tip ends of the protrusions 2*b* are configured as engagement parts 2*d* that engage the female screw member 5 in the rotation direction.

The clutch spring member 6 is made of a resin and has an approximately cylindrical shape. A tip end of the clutch spring member 6 is a part projecting from the tip of the cartridge housing container 2. A part rearward with respect to this tip end is an inner-insertion part inserted into the cartridge housing container 2. As illustrated in FIG. 1 to FIG. 3 and FIG. 6, a circular concave part 6*a* to axially engage the convex part 2*a* of the cartridge housing container 2 is disposed on an outer peripheral surface on a tip side of the inner-insertion part. As illustrated in FIG. 6, a plurality of (four pieces here) convex parts 6*c* are circumferentially disposed at regular intervals on an outer peripheral surface of the cylinder part rearward with respect to the concave part 6*a*. The convex parts 6*c* extend short in the axial direction and engage the above-described concave parts (not illustrated) on the cartridge housing container 2 in the rotation direction. A part rearward with respect to the convex parts 6*c* is a spring part 6*b*, which is a resin spring forming an approximately spiral pattern, expandable and contractable in the axial direction. On an inner peripheral surface of the cylinder part rearward with respect to this spring part 6*b*, a plurality of convex parts 6*d*, which axially engage a leading tube 3, are circumferentially disposed at regular intervals.

As illustrated in FIG. 1 to FIG. 3, the inner-insertion part of the clutch spring member 6 is inserted into the cartridge housing container 2 and the concave part 6*a* axially engages the convex part 2*a* on the cartridge housing container 2 to unmovably mount the clutch spring member 6 to the cartridge housing container 2 in the axial direction. Additionally, the convex parts 6*c* (see FIG. 6) engage the concave parts on the cartridge housing container 2 in the rotation direction such that the clutch spring member 6 is mounted to the cartridge housing container 2 unrotatable (synchronously rotatable) around the axis line. In this state, a rear end surface of the clutch spring member 6 abuts on top end surfaces of the protrusions 2*b* on the cartridge housing container 2.

As illustrated in FIG. 1 and especially in FIG. 5, the rod-shaped cosmetic material cartridge 1 includes the leading tube 3, the rod-shaped cosmetic material supporting body 4, and the female screw member 5. The leading tube 3 has a staged tubular shape that houses the rod-shaped cosmetic material M. The rod-shaped cosmetic material supporting body 4 as a movable body is disposed in the leading tube 3 and axially extends to move while supporting the rod-shaped cosmetic material M. The female screw member 5 is disposed in the leading tube 3 to move the rod-shaped cosmetic material supporting body 4.

The leading tube 3 has a large-diameter part 3*a* and a small-diameter part 3*b*. The large-diameter part 3*a* projects forward with respect to the top end surface of the clutch spring member 6 and is pinched by fingers. The small-diameter part 3*b* is installed consecutively to a rear end of this large-diameter part 3*a* via the stepped surface and is housed in the clutch spring member 6 and the cartridge housing container 2. As illustrated in FIG. 7 to FIG. 9, a rear end of the large-diameter part 3*a* has a cylindrical shape. The large-diameter part 3*a* has a shape with a reduced diameter as approaching the tip formed into an approximately elliptic cylindrical shape (an approximately oval cylindrical shape) so as to match the flat rod-shaped cosmetic material M (also see FIG. 4). Here, a top end surface 3*c* of the leading tube 3 is formed as an inclined surface inclined with respect to the axis line.

As illustrated in FIG. 3, a tube hole of the leading tube 3 is configured as a housing region to house the rod-shaped cosmetic material M and a supporting part 4*a* (details will be described later) of the rod-shaped cosmetic material supporting body 4 by the front half portion. The rear half portion is configured as a housing region with a diameter slightly larger than the front half portion to house the female screw member 5 (also see FIG. 1 and FIG. 2). The tube hole, which is at the front half portion of the leading tube 3, is configured as a flat rod-shaped cosmetic material hole 3*e* extending from an opening 3*h* at the tip rearward to ensure sliding of the rod-shaped cosmetic material M. A plurality of (four pieces here) support piece grooves 3*f* are installed consecutively (not shown in FIG. 1 and FIG. 2) at a plurality of positions (flat four corners here) at a peripheral area of this rod-shaped cosmetic material hole 3*e*. The support piece grooves 3*f* slidably house support pieces 4*d* (see FIG. 11), which will be described later, of the rod-shaped cosmetic material supporting body 4 from a position away from the opening 3*h* rearward by a predetermined length to the housing region for the female screw member 5 of the leading tube 3. The support piece grooves 3*f* to 3*f* nearby these rod-shaped cosmetic material hole 3*e* and rod-shaped cosmetic material hole 3*e* constitute an advance/retreat hole 3*g* in which the rod-shaped cosmetic material M and the support pieces 4*d* slide. The top end surfaces of the support piece grooves 3*f* illustrated in FIG. 3 are the advance limit of the rod-shaped cosmetic material supporting body 4 (the rod-shaped cosmetic material M) against which the top end surfaces of the support pieces 4*d* of the rod-shaped cosmetic material supporting body 4 bump.

As illustrated in FIG. 7 and FIG. 8, a circular concave part 3*d* is disposed on an outer peripheral surface at a rear end portion of the leading tube 3 to axially engage the convex parts 6*d*, which are rearward with respect to the spring part 6*b* of the clutch spring member 6. As illustrated in FIG. 1 to FIG. 3, a circular convex part 3*j* is disposed on an inner peripheral surface of the housing region for the female screw member 5 of the leading tube 3 around the middle in the axial direction to axially engage the female screw member 5.

As illustrated in FIG. 7 and FIG. 8, a large number of projections 3*k* project on the tip end of the leading tube 3, specifically, on the outer peripheral surface from positions slightly away rearward with respect to the top end surface 3*c* of the leading tube 3 to positions further away rearward by a predetermined length.

As illustrated in FIG. 7 to FIG. 9, the leading tube outer peripheral surface where the projections 3*k* project have an approximately elliptic cylindrical shape (an approximately oval cylindrical shape); therefore, the plurality of projections 3*k* are disposed on the outer surface approximately parallel to the longer axis (an approximately flat outer surface; a surface on a smaller curvature side in the case of the approximately elliptical shape). Here, the projections 3*k* are arranged so as to form rows by the plurality of projections 3*k* longitudinally and latitudinally. In this embodiment, as illustrated in FIG. 7, the projections 3*k* are arranged by seven pieces in the lateral direction and five pieces in the longitudinal direction. The arrangement of the projections 3*k* is not limited to the rows but may be, for example, a stagger pattern, and various kinds of arrangements are applicable.

As illustrated in FIG. 10, which is the enlarged view of FIG. 7, the projections 3*k* have an approximately triangular pole. One vertex position a face axially rearward in the axial direction, and another vertex position b face upward. Respective vertex positions of the projections 3*k* are slightly chamfered here. Reference numeral 3*t* indicates a bottom portion of the projection 3*k*. An action of these projections 3*k* will be described later.

Here, as illustrated in FIG. 2, FIG. 5, and FIG. 9, an outer peripheral part 3*m* is a part including the outer peripheral surface at which these plurality of projections 3*k* project, that is, a part on the outer peripheral side with an approximately elliptic cylindrical shape (an approximately oval cylindrical shape). The plurality of projections 3*k* and the outer peripheral part 3*m* are molded with a soft material and a main body 3*p* other than the projections 3*k* and the outer peripheral part 3*m* of the leading tube 3 is molded with a hard material harder than the soft material.

As the soft material, a thermoplastic polyester elastomer (TPEE) is used here and as the hard material, an acrylonitrile butadiene styrene (ABS) is used here; however, the materials are not limited to these. As illustrated in FIG. 3 and FIG. 5, the main body 3*p* here is an inner peripheral part 3*q* (also see FIG. 9) inside with respect to the outer peripheral part 3*m* and an interposing part 3*r*, which interposes this inner peripheral part 3*q* and the outer peripheral part 3*m* from the front and the rear in the axial direction.

The projections 3*k* and the outer peripheral part 3*m*, which are made of the soft material, and the main body 3*p* made of the hard material are molded by two-color molding. Specifically, first, the main body 3*p* as a primary side is molded with the hard material and then the projections 3*k* and the outer peripheral part 3*m* as a secondary side are molded with the soft material integrally with the main body 3*p* in the identical mold. Here, the leading tube 3 is formed by a different-material injection molding machine having two injection devices (a piston and a screw).

The rod-shaped cosmetic material M in the leading tube 3 is formed as the flat rod-shaped cosmetic material as described above. This is because that the flat shape is preferable to draw narrow lines.

The rod-shaped cosmetic material supporting body 4 is, for example, made of a polybutylene terephthalate (PBT). As illustrated in FIG. 3 and especially in FIG. 11, the rod-shaped cosmetic material supporting body 4 includes the supporting part 4*a*, which supports the rear end portion of the rod-shaped cosmetic material M, and a shaft body part 4*b*, which is disposed rearward with respect to this supporting part 4*a*. The shaft body part 4*b* is a shaft body extending in the axial direction. Screw projections 4*e* functioning as male screws are disposed on an outer peripheral surface at a rear end portion of this shaft body part 4*b* opposed to the shaft body part 4*b*. The supporting part 4*a* includes a base part 4*c* against which the rear end surface of the rod-shaped cosmetic material M bumps and the plurality of support pieces 4*d*, which support the rear end portion of the rod-shaped cosmetic material M bumped against the base part 4*c*. The base part 4*c* has a flat shape with a size identical to the flat rod-shaped cosmetic material M. The support pieces 4*d* are disposed at a plurality of positions (around four corners of the flat rod-shaped cosmetic material M in this embodiment) in the circumferential direction on the outer peripheral surface of the flat base part 4*c* so as to project to the tip side. The rear end portion of the rod-shaped cosmetic material M is fitted between these support pieces 4*d* and 4*d* to be supported.

The female screw member 5 is, for example, made of a polyacetal (POM) and as illustrated in FIG. 12, has an approximately closed-bottomed cylindrical shape. A female screw 5*a* (see FIG. 5) is disposed along the axial direction on the inner peripheral surface constituting the tube hole of the female screw member 5. The female screw member 5 has a circular concave part 5*b*, which axially engages the convex part 3*j* on the leading tube 3, at the approximately center on the outer peripheral surface in the axial direction.

A plurality of (eight pieces here) ribs 5*c* axially extending short project at regular intervals along the circumferential direction on the outer peripheral surface at the rear end portion of the female screw member 5. The ribs 5*c* engage the engagement parts 2*d* of the cartridge housing container 2 in the rotation direction.

With the rod-shaped cosmetic material supporting body 4 illustrated in FIG. 11, the shaft body part 4*b* is inserted into the female screw member 5 illustrated in FIG. 12, and the screw projections 4*e* of the shaft body part 4*b* are screwed with the female screw 5*a* of the female screw member 5. The rod-shaped cosmetic material supporting body 4 is screwed up to a retreating limit of the rod-shaped cosmetic material supporting body 4 where the rear end surface of the shaft body part 4*b* of the rod-shaped cosmetic material supporting body 4 bumps against the rear end surface inside the female screw member 5 (the inner bottom surface) (see FIG. 2 and FIG. 3). There may be a case where the retreating limit of the rod-shaped cosmetic material supporting body 4 is configured by bumping the rear end surface of the base part 4*c* of the rod-shaped cosmetic material supporting body 4 against the top end surface of the female screw member 5.

With reference to FIG. 3, these rod-shaped cosmetic material supporting body 4 and female screw member 5 are inserted into the leading tube 3 from the rear end of the leading tube 3. The base part 4*c* of the rod-shaped cosmetic material supporting body 4 enters to the rod-shaped cosmetic material hole 3*e* on the leading tube 3 and the support pieces 4*d* enter the support piece grooves 3*f* on the leading tube 3. Thus, the rod-shaped cosmetic material supporting body 4 is unrotatable with respect to the leading tube 3 around the axis line (synchronously rotatable) and movable in the axial direction.

The concave part 5*b* of the female screw member 5 axially engages the convex part 3*j* of the leading tube 3. Accordingly, the female screw member 5 is mounted to the leading tube 3 unmovable in the axial direction and rotatable around the axis line. Thus, the rod-shaped cosmetic material cartridge 1 (see FIG. 5) is obtained.

The rod-shaped cosmetic material cartridge 1 is inserted into the cartridge housing container 2 from the female screw member 5 side. As illustrated in FIG. 1 and FIG. 2, the stepped surface on the outer peripheral surface of the leading tube 3 is bumped against the top end surface of the clutch spring member 6 and the concave part 3*d* on the leading tube 3 axially engages the convex parts 6*d* on the clutch spring member 6. Thus, the rod-shaped cosmetic material cartridge 1 is mounted to the clutch spring member 6 rotatable around the axis line and attachable/detachable in the axial direction. In this state, the ribs 5*c* of the female screw member 5 engage the engagement parts 2*d* of the cartridge housing container 2 in the rotation direction. Thus, the female screw member 5 is unrotatable (synchronously rotatable) to the cartridge housing container 2 around the axis line.

A cap 7 is attachably/detachably mounted to the clutch spring member 6 so as to cover the tip end of the clutch spring member 6 projecting from the cartridge housing container 2 and the leading tube 3.

With the rod-shaped cosmetic material feeding container 100, when the user removes the cap 7 and relatively rotates the leading tube 3 and the cartridge housing container 2 in the feed direction (the rotating operation), a screwing action by the screw projections 4*e* of the rod-shaped cosmetic material supporting body 4, which is synchronously rotatable with the leading tube 3, and the female screw 5*a* of the female screw member 5, which is synchronously rotatable with the cartridge housing container 2, acts to move the rod-shaped cosmetic material supporting body 4 forward (see FIG. 5).

When the rod-shaped cosmetic material M is fed (extruded) from the opening 3*h* on the tip of the leading tube 3 by a desired amount, the user draws the eyebrow with the rod-shaped cosmetic material M (applies the rod-shaped cosmetic material M).

Here, to comb and trim the eyebrow, the plurality of projections 3*k* are brought into contact with the eyebrow without inverting and changing the hold of the rod-shaped cosmetic material feeding container 100, and the rod-shaped cosmetic material feeding container 100 is stroked to move in the approximately lateral direction (the right direction in FIG. 7 and FIG. 10) so as to go along the flow of the hair of the eyebrow. Such operation ensures preferably combing and trimming the eyebrow. Since the vertex positions a of the projections 3*k* face rearward, the eyebrow can be further preferably combed and trimmed.

To gradate the eyebrow, neither the rod-shaped cosmetic material feeding container 100 is inverted nor the hold of the rod-shaped cosmetic material feeding container 100 is changed, the plurality of projections 3*k* are brought into contact with the eyebrow and the rod-shaped cosmetic material feeding container 100 is moved from downward to upward (from the lower side to the upper side in FIG. 7 and FIG. 10). Such operation allows preferably gradating the eyebrow. Since the vertex positions b on the projections 3*k* face upward, the eyebrow can be further preferably gradated.

These plurality of projections 3*k* allows the user to preferably perform processes such as the combing and the gradation in accordance with the direction that the user moves the plurality of projections 3*k* relative to the eyebrow. It is obvious that, as long as the vertex positions a face axially rearward while the other vertex positions b face upward, the projections with another polygonal shape, such as a diamond, also provide the similar actions and effects. While this multangular shape is employed for the projections as is especially preferable, for example, projections with a columnar shape and an elliptical column shape are also applicable.

After the above-described application with the rod-shaped cosmetic material M and combing process and gradation process with the plurality of projections 3*k*, the user relatively rotates (the rotating operation) the leading tube 3 and the cartridge housing container 2 in a feedback direction, which is a direction opposite to the feed direction. Then, the rod-shaped cosmetic material supporting body 4 retreats and the rod-shaped cosmetic material M sinks from the opening 3*h* on the tip of the leading tube 3.

In the case where the rod-shaped cosmetic material supporting body 4 reaches the advance limit illustrated in FIG. 5 and further the user continues the rotating operation in the feed direction, the rod-shaped cosmetic material supporting body 4 attempts to move forward and pushes the leading tube 3. Thus, the leading tube 3 attempts to move forward. Since the concave part 3*d* on the leading tube 3 axially engages the convex parts 6*d*, which are disposed rearward with respect to the spring part 6*b* of the clutch spring member 6, the spring part 6*b* is compressed and the leading tube 3 and the female screw member 5 move forward. The forward movement of these leading tube 3 and female screw member 5 disengages the ribs 5*c* of the female screw member 5 from the engagement parts 2*d* of the cartridge housing container 2, thus cutting off the rotational force by the relative rotation. Such cutoff state stretches the spring part 6*b*, retreats the leading tube 3 and the female screw member 5, and engages the ribs 5*c* and the engagement parts 2*d* in the rotation direction. The spring part 6*b* functions as the so-called clutch repeating the engagement/disengagement in association with the relative rotation to avoid an application of an overload to the components. In the case where the rod-shaped cosmetic material supporting body 4 reaches the retreating limit illustrated in FIG. 1 and further the user continues the rotating operation in the feedback direction, the spring part 6*b* also functions as the clutch similar to the case of advance limit.

As described above, while this embodiment allows the application of the rod-shaped cosmetic material M extruded from the opening 3*h* on the top end surface 3*c* of the leading tube 3 to the eyebrow, the processes to comb and gradate the eyebrow can be performed with the plurality of projections 3*k*, which project on the outer surface rearward with respect to the top end surface 3*c* of the leading tube 3 and are made of the soft material, without inverting the rod-shaped cosmetic material feeding container 100 and changing the hold of the rod-shaped cosmetic material feeding container 100.

Here, the entire main body 3*p* other than the projections 3*k* and the outer peripheral part 3*m* of the leading tube 3 are made of the hard material as especially preferable. Meanwhile, it is only necessary for the leading tube 3 to be made of the hard material not the entire main body 3*p* but the inner peripheral part 3*q* inside with respect to the outer peripheral part 3*m* and the interposing part 3*r*, which interposes these inner peripheral part 3*q* and outer peripheral part 3*m* from the front and the rear in the axial direction. That is, it is only necessary for the leading tube 3 to include the projections 3*k* and the outer peripheral part 3*m* made of the soft material and the inner peripheral part 3*q* and the interposing part 3*r* made of the hard material, and be constituted of the two kinds of materials.

This embodiment has the tubular outer peripheral part 3*m*; therefore, the outer peripheral part 3*m* does not drop from the leading tube 3.

The above-described manufacturing method according to the embodiment molds the projections 3*k* and the outer peripheral part 3*m* of the leading tube 3 with the soft material, and the inner peripheral part 3*q* and the interposing part 3*r* are molded with the hard material. Additionally, the projections 3*k* and the outer peripheral part 3*m*, which are molded with the soft material, are integrally molded with the inner peripheral part 3*q* and the interposing part 3*r*, which are molded with the hard material, by the two-color molding using the two kinds of materials, thereby ensuring easily manufacturing the leading tube 3.

While the present disclosure has been specifically described based on the embodiment, the present disclosure is not limited to the embodiment. For example, the embodiment configures the rod-shaped cosmetic material cartridge 1 to be removably attachable to the cartridge housing container 2. However, the rod-shaped cosmetic material cartridge 1 may be configured to be unremovable and the rod-shaped cosmetic material cartridge 1 illustrated in FIG. 5 alone is applicable. In this case, relatively rotating the leading tube 3 and the rear end portion of the female screw member 5 (a part having the ribs 5*c*) allows the rod-shaped cosmetic material M to appear and disappear from the leading tube 3.

The male screw and the female screw may work similarly to a screw thread like a group of projections intermittently disposed or a group of projections spirally and intermittently disposed. Alternatively, the screw projections may be a continuous screw thread.

While the embodiment configures the flat rod-shaped cosmetic material M, for example, a rod-shaped cosmetic material with a circular cross-sectional surface and a polygonal cross-sectional surface may be employed. In this case, the rod-shaped cosmetic material hole 3*e* and the advance/retreat hole 3*g* through which the rod-shaped cosmetic material passes needs to be changed according to the shape of the rod-shaped cosmetic material.

In the case where the rod-shaped cosmetic materials with the circular cross-sectional surface and the polygonal cross-sectional surface are employed, the leading tube is preferably changed into the cylindrical shape and a polygonal tube shape so as to match the shape of the rod-shaped cosmetic material. With such cylindrical-shaped and the polygonal-tube-shaped leading tube, the plurality of projections 3*k* are preferably disposed on a whole circumference of the outer peripheral part 3*m*.

The embodiment configures the top end surface 3*c* of the leading tube 3 as the inclined surface and thins the end portion of this inclined surface in the longer axis direction to thin the rod-shaped cosmetic material M part corresponding to this end portion as well, which is preferable to draw the narrow lines; however, the top end surface 3*c* may be a surface perpendicular to the axis line.

The embodiment configures the outer peripheral part 3*m* to have the cylindrical shape (the circular shape) to avoid this outer peripheral part 3*m* to drop from the leading tube 3. Meanwhile, the outer peripheral part 3*m* can have an approximately C-shaped semicircle or more with a predetermined thickness to reduce the drop of the outer peripheral part 3*m* from the leading tube 3. With the configuration that includes such approximately C shape, which does not complete a circle, the outer peripheral part 3*m* becomes an outer surface side part where the projections 3*k* project rearward with respect to the top end surface 3*c*, the inner peripheral part 3*q* is positioned inside this outer surface side part and becomes a tube hole formation part, which forms a tube hole, and the interposing part 3*r* becomes a part interposing the tube hole formation part and the outer surface side part from the front and the rear in the axial direction. That is, the leading tube 3 includes the projections 3*k* and the outer surface side part made of the soft material and includes the tube hole formation part and the interposing part made of the hard material, thus constituted of the two kinds of materials.

The embodiment employs the rod-shaped cosmetic material M as the rod-shaped cosmetic material for eyebrow as especially preferable to ensure combing and gradating the eyebrow with the projections 3*k*. Meanwhile, the present disclosure is also applicable to various rod-shaped cosmetic materials such as an eyeliner, a lip liner, and a concealer and further is also applicable to a liquid cosmetic material such as an eyebrow cosmetic and an eyeliner. In addition to the application to the cosmetic material such as the rod-shaped cosmetic material and the liquid cosmetic material, the present disclosure is also applicable to, for example, a hair dye liquid, which partially dyes a hair, and a shoe polish. The present disclosure is also applicable to a squeeze container such as a tube and a soft bottle that can extrude a content such as these cosmetic materials, hair dye liquid, and shoe polish from an opening at a container tip. Further, the present disclosure is also applicable to a container of a type where a content comes out of an opening at a container tip by capillarity of a batting (an intermediate core) or the like disposed in the container. The present disclosure is also applicable to a writing material, a painting material, and a similar material. In short, the present disclosure is applicable to all applying containers where the internally housed content passes through a tube hole on a leading tube and comes out of an opening on a top end surface of this leading tube to ensure the application of the content.

What is claimed is:

1. An applying container configured to apply a content housed inside the applying container, the content passing through a tube hole at a leading tube and appearing from an opening at a top end surface of the leading tube for the application, the applying container comprising the leading tube that includes:

a plurality of projections made of a soft material, the plurality of projections projecting at an outer surface rearward with respect to the top end surface;

an outer surface side part made of the soft material, the plurality of projections projecting at the outer surface side part rearward with respect to the top end surface;

the plurality of projections including a plurality of projections arranged in a longitudinal direction of the leading tube, and a plurality of projections arranged in a lateral direction of the leading tube;

a tube hole formation part made of a hard material harder than the soft material, the tube hole formation part being positioned inside the outer surface side part, the tube hole formation part forming the tube hole; and an interposing part made of the hard material harder than the soft material, the interposing part interposing the tube hole formation part and the outer surface side part from a front and a rear in an axial direction, wherein the leading tube is constituted of the two kinds of materials.

2. The applying container according to claim 1, wherein the outer surface side part is configured to have a tubular shape.

3. The applying container according to claim 2, wherein the content is rod-shaped cosmetic material for eyebrow.

4. The applying container according to claim 1, wherein the content is rod-shaped cosmetic material for eyebrow.

5. The applying container according to claim 1, wherein the leading tube having a flat shape with a flat outer surface in which the projections are provided only on a side of the leading tube having the flat outer surface.

6. The applying container according to claim 1, wherein each of the projections including at least two vertices, the vertices including a first vertex facing rearward with respect to the top end surface in an axial direction of the leading tube, and a second vertex facing in a direction transverse to the axial direction of the leading tube.

7. A method for manufacturing an applying container configured to apply a content housed inside the applying container, the content passing through a tube hole at a leading tube and appearing from an opening at a top end surface of the leading tube for the application, the method comprising:

molding a plurality of projections and an outer surface side part of the leading tube with a soft material, the plurality of projections projecting at an outer surface rearward with respect to the top end surface, the plurality of projections projecting at the outer surface side part rearward with respect to the top end surface; the plurality of projections including a plurality of projections arranged in a longitudinal direction of the leading tube, and a plurality of projections arranged in a lateral direction of the leading tube; and molding a tube hole formation part and an interposing part of the leading tube with a hard material harder than the soft material, the tube hole formation part being positioned inside the outer surface side part, the tube hole formation part forming the tube hole, the interposing part interposing the tube hole formation part and the outer surface side part from a front and a rear in an axial direction, wherein the projections and the outer surface side part molded with the soft material and the tube hole formation part and the interposing part molded with the hard material are integrally molded with the two kinds of materials by a two-color molding.

8. The method for manufacturing an applying container according to claim 7, wherein the leading tube having a flat shape with a flat outer surface in which the projections are provided only on a side of the leading tube having the flat outer surface.

9. The method for manufacturing an applying container according to claim 7, wherein each of the projections including at least two vertices, the vertices including a first vertex facing rearward with respect to the top end surface in an axial direction of the leading tube, and a second vertex facing in a direction transverse to the axial direction of the leading tube.

* * * * *